United States Patent [19]

Schoonover et al.

[11] 4,015,983

[45] Apr. 5, 1977

[54] METHOD OF ERASING MANIFOLD IMAGES

[75] Inventors: Philip C. Schoonover, E. Rochester, N.Y.; Martin S. Maltz, Mississauga, Canada

[73] Assignee: Xerox Corporation, Samford, Conn.

[22] Filed: June 30, 1976

[21] Appl. No.: 701,324

Related U.S. Application Data

[63] Continuation-in-part of Ser. No. 575,107, May 6, 1975, abandoned.

[52] U.S. Cl. ..... 96/1 M

[51] Int. Cl.[2] ..... G03G 17/00; G03G 13/00

[58] Field of Search ..... 96/1 M, 1 R

[56] References Cited

UNITED STATES PATENTS

| | | | |
|---|---|---|---|
| 3,438,772 | 4/1969 | Gundlach | 96/1 R |
| 3,573,904 | 4/1971 | Clark | 96/1 M |
| 3,653,892 | 4/1972 | Gundlach et al. | 96/1.3 |
| 3,655,372 | 4/1972 | Krohn et al. | 96/1.3 |
| 3,676,116 | 7/1972 | Krohn et al. | 96/1.3 |
| 3,692,518 | 9/1972 | Reinis et al. | 96/1 M |
| 3,761,258 | 9/1973 | Menz | 96/1 M |
| 3,861,910 | 1/1975 | Kropac et al. | 96/1 M |

*Primary Examiner*—David Klein
*Assistant Examiner*—John R. Miller
*Attorney, Agent, or Firm*—James J. Ralabate; Richard A. Tomlin; Max J. Kenemore

[57] ABSTRACT

A fracturable manifold image is created in an imaging layer sandwiched between donor and receiver sheets by a conventional manifold imaging process using an imaging electrostatic field of a predetermined voltage. The fracturable manifold image is erased by uniformly applying in the dark a second electrostatic field of the same polarity as the first field but of sufficiently greater strength to cause substantially the entire imaging layer to preferentially adhere to one of the sheets. After the fracturable image has been created, but before erasure, the sandwich can be separated while still under the influence of the first field to provide a positive image on one sheet and a negative image on the other sheet and then reassembled substantially in registration. Subsequent such images can be made and erased provided that the imaging field for each subsequent image has at least the strength of the next previous erasure field.

4 Claims, 4 Drawing Figures

METHOD OF ERASING MANIFOLD IMAGES

CROSS REFERENCE TO RELATED APPLICATIONS

This invention is a continuation-in-part of the copending application Ser. No, 575,107, filed May 6, 1975, now abandoned.

BACKGROUND OF THE INVENTION

The present invention relates in general to imaging and, more specifically, to a process for the formation and subsequent erasure of images by layer transfer in image configuration, which process provides for a reusable imaging layer.

Imaging systems of the type referred to above, commonly known as "manifold imaging" generally comprise forming a sandwich of a donor and a receiver sheet with a photo-responsive imaging material therebetween. When the imaging material is subjected to and electrostatic field while being exposed to electromagnetic radiation, the imaging material fractures at the boundaries of the image elements and selectively adheres to the donor or receiver in accordance with the pattern of either the electrostatic field or the light. The sandwich may then be stripped apart and there is a positive pattern of the image on the receiver and a negative pattern on the donor.

U.S. Pats. to Clark, No. 3,573,904; Davidson No. 3,642,363; and Krohn No. 3,615,393 more fully describe the manifold imaging system referred to above.

U.S. Pats. No. 3,692,518 to Reinis et al and 3,861,910 to Kropac et al disclose manifold imaging systems in which the fracturable manifold image is created in the imaging layer of a manifold sandwich in the presence of a first field. The sandwich is separated to produce an image on the donor and receiver sheets in the presence of a second field. The second field can have a strength greater than that of the first field.

The disclosures of both Kropac et al and Reinis et al are directed to the making of manifold images and not to erasure of such images. Neither patent discloses nor shows by way of example the use of second fields having a strength sufficiently greater than that of the first field to result in erasure of a manifold image by causing the imaging layer to adhere substantially entirely to one of the donor or receiver sheets of the sandwich.

Other disclosures of conventional manifold imaging systems are found in U.S. Pat. Nos. 3,438,772 to Gundlach; 3,655,372 and 3,676,116 to Krohn et al and 3,761,258 to Meng.

U.S. Pat. No. 3,653,892 to Gundlach et al, describes a manifold imaging system wherein the image on the stripped receiver is observed or otherwise used, then the sandwich is reassembled in approximately its original registration and the image is erased by reversing the polarity of the electrostatic field while flooding the reassembled sandwich with light whereupon the sandwich may be reused.

SUMMARY OF THE INVENTION

It is, therefore, an object of this invention to enable the erasure of manifold images while avoiding the necessity of field reversing switches or flood lighting means.

It is another object of this invention to afford a means for inspecting manifold images for errors or other deficiencies, erasing undesirable images and producing corrected manifold images from the same sandwich.

It is also an object of this invention to supply a simple and economical manifold imaging system which can be used to produce corrected final images.

These and other objects are provided by a method for forming and erasing manifold images which comprises, generally speaking, the steps of forming a manifold image in the imaging layer of a conventional manifold sandwich and erasing the image by applying in the dark an electrical field of the same polarity as the conventional imaging field but having a strength sufficiently greater than the imaging field to erase the image by causing substantially all of the imaging layer to preferentially adhere to one side of the sandwich.

If desirable, the manifold sandwich can be separated for inspection of the manifold image. The sandwich can then be reassembled, substantially in registration, prior to the erasure step. The conventional imaging field is maintained during the separation and reassembly of the manifold sandwich.

Subsequent sequences can be performed on the manifold sandwich in which each subsequent imaging field has at least the strength of the next previous erasure field.

BRIEF DESCRIPTION OF THE DRAWINGS

For a better understanding of the invention as well as other objects and further features thereof, reference is made to the following detailed disclosure of the preferred embodiments of the invention taken in conjunction with the accompanying drawings thereof wherein.

DESCRIPTION OF A PREFERRED EMBODIMENT

Figure 1:
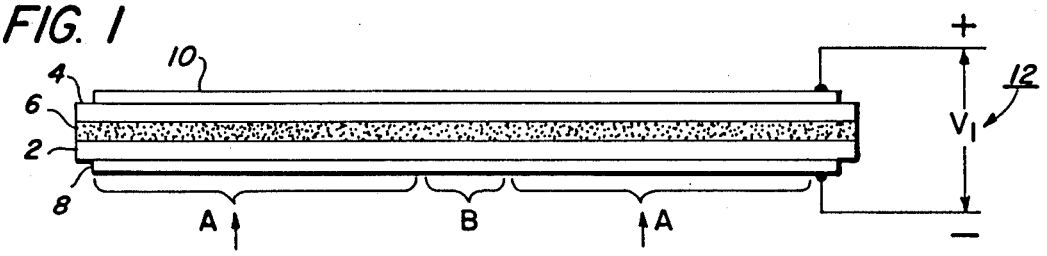
FIGS. 1 to 4 are schematic views illustrating successive steps in the practice of this invention, FIG. 1 being a sectional view and FIGS. 2–4 being side elevational views.

FIG. 1 illustrates a more or less conventional manifold imaging arrangement in which a sheet of receiver material 2 and a sheet of donor material 4 are arranged in a sandwich arrangement with imaging material 6 therebetween. The donor and receiver sheets may be the same or similar materials such, for example, as polyethylene terephthalate, known commonly as "Mylar." Suitable materials, however, are more fully disclosed in the patents previously referred to. The imaging material 6 may be any of the materials commonly referred to as photo-responsive inks, which are responsive to visible light or ultra violet radiation, all as described in the patents previously referred to and to which reference is made. The receiver material 2 is preferably precharged to uniform surface charge density although this is not always necessary.

After the sandwich is formed as described, it is subjected to an electrostatic field, for example, by means of the electrodes 8 and 10 connected to a suitable voltage source generally designated 12. At least the receiver 2 and the electrode 8 must be transparent to the actinic radiation to which the particular imaging material is sensitive and after the sandwich is formed as described, it is exposed to an optical image wherein the bracketed areas designated A are illuminated and the bracketed area B is maintained dark, that is, no light impinges thereon.

As is known, the combination of the electrostatic field and the electromagnetic radiation in the form of an image causes the imaged material 6 to "fracture"

along the boundaries between the illuminated and non-illuminated portions of the applied image.

Figure 2:
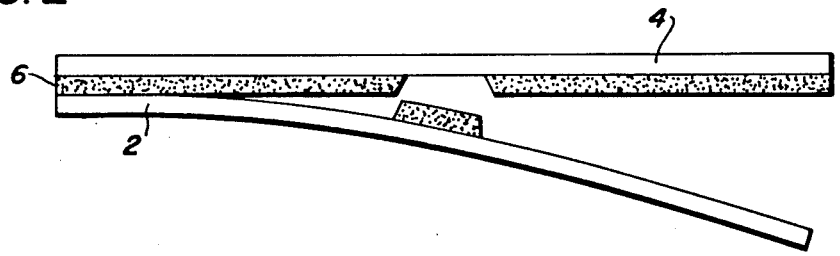
Figure 3:
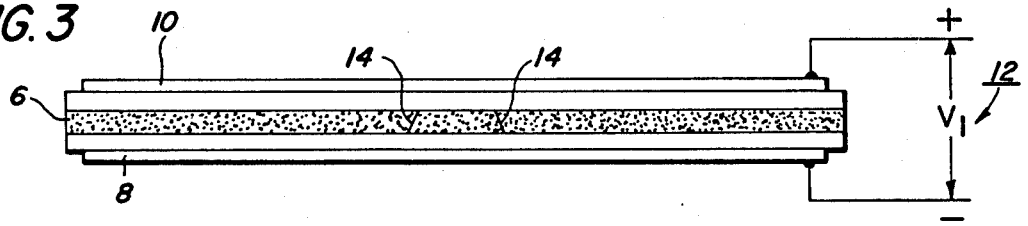
Figure 4:
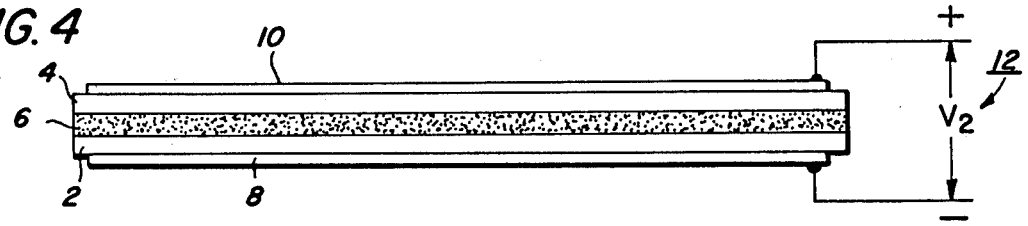

The combination of the field and illumination also causes the imaging material 6 in the illuminated areas to adhere to the donor 4 with greater tenacity than to the receiver 6 whereas in the dark areas (B), the imaging material adheres more tenaciously to the receiver 2 than to the donor. Prior to exposure to the optical image, presumably due to the presence of the electrostatic field, the imaging material all tends to adhere to the receiver 2. After exposure, the receiver 2 may be stripped from the sandwich, as schematically illustrated in FIG. 2, whereupon a positive developed image appears on the receiver and a negative image is retained on the donor 4. All of the steps prior to the stripping of the receiver from the sandwich are performed in darkness, the only light to which the sandwich is exposed being the optical image described. However, after stripping the receiver from the sandwich, exposure to light has no deleterious effect and the positive image on the receiver may be inspected in ambient room light without deleterious effects. In this manner, any errors or other deficiencies in the image may be observed and the original document from which the image was produced may be corrected. After such stripping and document correction, the sandwich is reassembled in substantially its original registration, as shown in FIG. 3, while the original electrostatic voltage VI is maintained thereon. However, under these conditions, the imaging material 6 remains "fractured" in the regions designated 14 although the different portions of the imaging material occupy their original positions. The step of reassembling the sandwich to the condition of FIG. 3 and the subsequent step, to be described, are performed in darkness. After the sandwich is reassembled to the form of FIG. 2, the electrostatic voltage VI is increased to a higher value designated V2 in FIG. 4. V2 must be sufficiently higher than VI to have the effect of driving substantially all of the imaging material 6 back into a preferentially adhesive relation to the receiver 2 whereupon the previously inspected image is erased. At this point the sandwich may be reexposed to the image from a corrected original document while maintaining the higher electrostatic field under voltage V2 and the previous steps may be repeated if necessary until a perfect copy is produced. There is a limitation, however, on the number of times erasure and reexposure can be performed since each successive exposure must be performed under a higher voltage and the limit to the number of times erasure and reexposure can be accomplished is determined by the "breakdown" voltage of the donor and receiver materials 2 and 4.

Once a desired image is produced on the receiver, that receiver may be employed in any of the conventional or known manners, such as use as a master from which copies may be directly made or as a transparency for projection of the image for viewing, or in any other suitable manner known in the art.

The foregoing description was based on the projection of an optical image onto the sandwich. However, it is within the scope of the present invention to effect imaging by flooding the sandwich with actinic radiation and applying the electrostatic field in the desired image pattern. Such an alternative method is known in the art and described in the patent to Clark, previously referred to. In the drawings, the voltage source 12 is shown as being connected to the electrodes 8 and 10 in the polarity noted on the figures. However, the designation of polarity on the figures is merely for the purpose of illustrating the fact that the same polarity of the field existing when the image was originally made. This distinguishes over the method described by Gundlach et al wherein the polarity of the field is reversed and the sandwich is flooded with light. Surprisingly, applicants have found that the application of an electrostatic field of the same polarity but sufficiently higher voltage effects erasure of the image from the reassembled sandwich without flooding the same with light and thus the use of complex, high voltage switching circuitry is avoided and it is not necessary to provide flood lighting means.

The description of electrodes 8 and 10 is also merely illustrative since the required electrostatic field may be provided by a charge in one of the sheets 2 or 4, as described in the mentioned patent to Krohn.

The following examples further specifically illustrate various preferred embodiments of the present invention.

EXAMPLE I

A 250ml. polyethylene bottle is filled ⅓ to ½ full with ⅛ to ½ inch diameter milling stones and a first mixture comprising 2.5g. *x*-form metal free phthalocyanine, 2.8g. Irgazine red BLT purified pigment (available from Geigy), 1.2g. Algol yellow GC concentrated (available from GAF) and 80ml. Sohio 3440 purified (available from Standard Oil of Ohio) is placed in the bottle with the stones. The mixture is milled for 4 hours at 120 to 125 linear ft./min.

While the first mixture is milling, 1.9g. of purified Elvax 20 (available from DuPont), 1.9g. Paraflint Hl microcrystaline wax (available from Moore and Munger) and 3.8g. Polyethylene DYLT (available from Union Carbide) is dissolved in 20ml. Sohio 3440 solvent by heating and stirring to form a second mixture.

The second mixture is cooled to room temperature, forming a semi-hard resin paste. The paste is added to the first mixture and the combined mixtures are milled overnight.

After milling, the combined mixture is poured into a 100ml. beaker equipped with a 1 to 1½ inch magnetic stirring bar and heated with stirring until a temperature of 115°–120° C is reached and pigment particles begin to form on the side of the beaker. The combined mixture is cooled to room temperature, and a paste forms which is broken up with a spatula. The paste is coated onto a 2ml. sheet of Stirling Litho CIS paper (available from Stirling Paper Co.) with a No. 22 wire wound draw down rod to form a 100 micron coating.

The coating side of the paper is placed against a 1 mil Mylar sheet (available from DuPont) to form a manifold sandwich. The sandwich is then placed between a pair of NESA glass transparent electrode plates (available from Pittsburg Plate Glass). The transparent electrode coatings on the NESA plates are connected to a D.C. voltage source and a field of 5,000 volts (5Kv) is placed across the sandwich.

The coating is exposed through the NESA plate on the Mylar side to a light image for 5 seconds through an f/22 aperture in an optical system providing an illumination of about 0.2 ft./candle seconds. After exposure the sandwich is separated in the dark while the 5Kv field is maintained. A good reproduction of the optical image is then observed in room light on the Mylar and a clear reverse image is observed on the paper.

The sandwich is then reassembled in the dark substantially in registration. A second voltage of 6Kv of the same polarity as the 5Kv voltage is applied, and the sandwich is separated to observe whether erasure has occurred. No erasure is observed. The sandwich is again reassembled substantially in registration and a voltage of 7Kv is applied. The sandwich is separated and some erasure is observed; however, the adherence of the coating to the Mylar is spotty and incomplete. Satisfactory erasure is deemed not to have occurred.

The sandwich is reassembled a third time in the same manner as before and a voltage of 7.5Kv is applied. Upon separation substantially complete erasure is observed with the entire coating adhering preferentially to the Mylar.

The sandwich is reassembled for a fourth time and exposed to a different optical image with the same illumination as before but with the field across the sandwich having a 7.5Kv. strength. The sandwich is separated in the dark while still under the influence of the 7.5Kv. field and then observed in room light. A good reproduction of the second image is observed on the Mylar and a reverse of the second image is observed on the paper.

EXAMPLE II

In Example II the same materials and procedures are used as in Example I except that the starting voltage for the first imaging step is 3Kv. A good image is produced using a 3Kv. field, and it is satisfactorily erased with a 5Kv. voltage of the same polarity.

A second clear image is produced in the same sandwich with a 5Kv. field, and it is satisfactorily erased with a 7.5Kv. field. A third image is produced in the same sandwich using a 7.5Kv. imaging field. However, efforts to erase the third image are not successful because of electrical breakdown in the sandwich when voltages higher than about 7.5Kv. are applied.

EXAMPLE III

The coating material of Example I is prepared by substantially the same procedure except that the amounts of Polyethylene DYLT and Paraflint Hl are reduced and an amount of Piccotex 75 (available from Pennsylvania Industrial Chemical Company), a resin, is added to compensate. The Piccotex 75 results in a generally harder final coating.

The coating material is placed in a 0.5 mil dried thickness on a 1 mil Mylar sheet. The coated side of the Mylar is activated by spraying with Sohio 3440 and then placed against a 2 mil aluminum foil sheet (with rolling to remove entrapped air bubbles) to form a manifold sandwich. The Mylar side of the sandwich is placed against a NESA plate to serve as one electrode. The aluminum foil serves as the second electrode.

The sandwich of Example III is imaged through the NESA plate as in Example I except that a 2Kv. imaging voltage is used. A good image is observed on the aluminum foil when the sandwich is separated. Erasure of the image is attempted by the procedure of Example I using a second field of the same polarity having a strength of 6Kv. Although some erasure is observed it is deemed not to be sufficiently complete to be acceptable. The sandwich is reassembled and erasure is attempted using a field strength of 7Kv. Upon separation of the sandwich, erasure is observed to be complete. Substantially all of the coating material is observed to adhere to the Mylar.

The sandwich is then reassembled and reimaged using a second optical image and a field strength of 7Kv. A good image is observed on aluminum foil.

It will be appreciated that other variations and modifications will occur to those skilled in the art upon reading the present disclosure. For example, the stripping of the sandwich, as shown in FIG. 2, and visual inspection thereof, is not essential to the practice of the invention. In some instances, the necessity or desirability of erasing a latent image from the sandwich without stripping the same apart may be known initially and thus the image indicated in FIG. 1 may be immediately erased by practicing the present process. This and other variations are intended to be within the scope of this invention.

What is claimed is:

1. A method for forming and erasing a manifold image which comprises the steps of:

a. providing a sandwich comprising a layer of electrically photosensitive imaging material interpositioned between a donor sheet and a receiver sheet, said layer being structurally fracturable in response to the combined effect of an applied electrical field and exposure to electromagnetic radiation to which said material is sensitive, at least one of said sheets being at least partially transparent to said electromagnetic radiation;

b. exposing said layer to said electromagnetic radiation while said layer is subjected to a first electrical field of a predetermined voltage, one of said first electrical field and said radiation comprising an imagewise pattern while the other is uniformly applied to said imaging material layer, whereby a fracturable manifold image is created in said layer responsive to said imagewise pattern; and c. uniformly applying in the dark an erasure electrical field of the same polarity as said first electrical field, said erasure electrical field having a voltage sufficiently higher than said predetermined voltage to cause substantially all of said layer to adhere preferentially to one of said sheets, whereby said fracturable manifold image is erased from said sandwich.

2. The method of claim 1 including the additional steps, between the steps of exposing said layer to electromagnetic radiation and uniformly applying in the dark an erasure electrical field, of:

a. separating said sandwich while said sandwich is subjected to said first electrical field, whereby the fracturable manifold imaged layer fractures in said pattern configuration with the image portion of said layer adhering to one of said donor and receiver sheets and the non-image portion of said imaging layer adhering to the other of said sheets; and b. reassembling said sandwich substantially in registration while maintaining an electrical field of said first predetermined voltage and polarity thereon.

3. The method of claim 1 including the further step of reimaging said layer by re-exposing said layer to electromagnetic radiation to which it is sensitive while said layer is subjected to a subsequent electrical field having a voltage of not less than that of said erasure electrical field, one of said subsequent electrical field and said radiation comprising an imagewise pattern while the other is uniformly applied to said imaging material layer, whereby a subsequent manifold image is formed in said layer.

4. The method of claim 3 wherein the layer containing the subsequent manifold image is erased and reimaged at least one additional time.

* * * * *